US009346520B2

(12) United States Patent
Knezek et al.

(10) Patent No.: US 9,346,520 B2
(45) Date of Patent: May 24, 2016

(54) SYSTEM AND METHOD FOR OFFSHORE LOADING OF CARGO VESSELS

(71) Applicant: Truston Technologies, Inc., Broussard, LA (US)

(72) Inventors: Erick B. Knezek, Lafayette, LA (US); Matthew A. Marcy, Annapolis, MD (US); William Stewart, Houston, TX (US)

(73) Assignee: TRUSTON TECHNOLOGIES, INC., Annapolis, MD (US)

( * ) Notice: Subject to any disclaimer, the term of this patent is extended or adjusted under 35 U.S.C. 154(b) by 0 days.

(21) Appl. No.: 14/372,671

(22) PCT Filed: Jan. 24, 2013

(86) PCT No.: PCT/US2013/022943
§ 371 (c)(1),
(2) Date: Jul. 16, 2014

(87) PCT Pub. No.: WO2013/112715
PCT Pub. Date: Aug. 1, 2013

(65) Prior Publication Data

US 2015/0017849 A1 Jan. 15, 2015

Related U.S. Application Data

(60) Provisional application No. 61/591,522, filed on Jan. 27, 2012.

(51) Int. Cl.
*B63B 27/30* (2006.01)
*B63B 21/50* (2006.01)

(Continued)

(52) U.S. Cl.
CPC ..... *B63B 27/30* (2013.01); *B63B 21/50* (2013.01); *B63B 22/02* (2013.01); *B63B 2021/003* (2013.01); *B63B 2021/008* (2013.01)

(58) Field of Classification Search
CPC ..... B63B 27/30; B63B 21/50
USPC ..... 441/3
See application file for complete search history.

(56) References Cited

U.S. PATENT DOCUMENTS 3,950,805 A * 4/1976 Murphy ..... B63B 22/021 405/203
3,968,954 A * 7/1976 Casco ..... B63B 21/16 242/225

(Continued)

*Primary Examiner* — Lars A Olson
*Assistant Examiner* — Jovon Hayes
(74) *Attorney, Agent, or Firm* — Law Office of Jesse D. Lambert, LLC

(57) ABSTRACT

A system and method for offshore loading of large cargo vessels, or motherships. The system includes a plurality of mooring stations, which may be mooring buoys, positioned in an offshore mooring field proximal an onshore cargo loading facility. A mothership is positioned within the mooring field and moored via bow and stern lines to two or more different mooring stations. Environmental data, including wind, wave, and current data, as well data regarding the physical characteristics of the mothership and movement (roll/pitch/heave) of the mothership are collected by remote transmitting and sensing devices. This data is processed by numerical analysis in a digital processor, namely a computer, to determine optimum mooring line length and tension, and mooring station locations, in order to minimize mother ship movement and create an optimum "lee" loading area adjacent the mothership. Cargo is transferred to the mothership by a trans-shipper moored to the mothership.

11 Claims, 10 Drawing Sheets

(51) Int. Cl.
*B63B 22/02* (2006.01)
*B63B 21/00* (2006.01)

(56) References Cited

U.S. PATENT DOCUMENTS 4,762,456 A * 8/1988 Nelson ..... B66C 23/52 212/307
5,154,561 A * 10/1992 Lee ..... B63B 27/12 114/264
5,501,625 A * 3/1996 Belinsky ..... B63B 21/00 114/230.2
5,941,746 A * 8/1999 Isnard ..... B63B 21/508 114/230.12
6,050,767 A * 4/2000 Gay ..... B65G 63/008 414/139.8
6,524,050 B1 * 2/2003 Arntzen ..... B63B 27/02 104/98
6,558,215 B1 * 5/2003 Boatman ..... B63B 22/021 114/230.13
6,931,314 B2 * 8/2005 Holland ..... B65G 63/004 414/139.4
6,932,326 B1 * 8/2005 Krabbendam ..... B63B 27/10 114/258
6,983,712 B2 * 1/2006 Cottrell ..... B63B 27/24 114/230.15
7,080,673 B2 * 7/2006 Pollack ..... F17C 5/06 141/284
7,100,438 B2 * 9/2006 LeMieux ..... B63B 39/00 290/55
7,673,577 B2 * 3/2010 Poldervaart ..... B63B 27/24 114/230.1
2002/0197135 A1 * 12/2002 Arntzen ..... B63B 27/02 414/140.3
2003/0061980 A1 * 4/2003 Cottrell ..... B63B 21/50 114/292
2015/0017849 A1 * 1/2015 Knezek ..... B63B 22/02 441/3

* cited by examiner

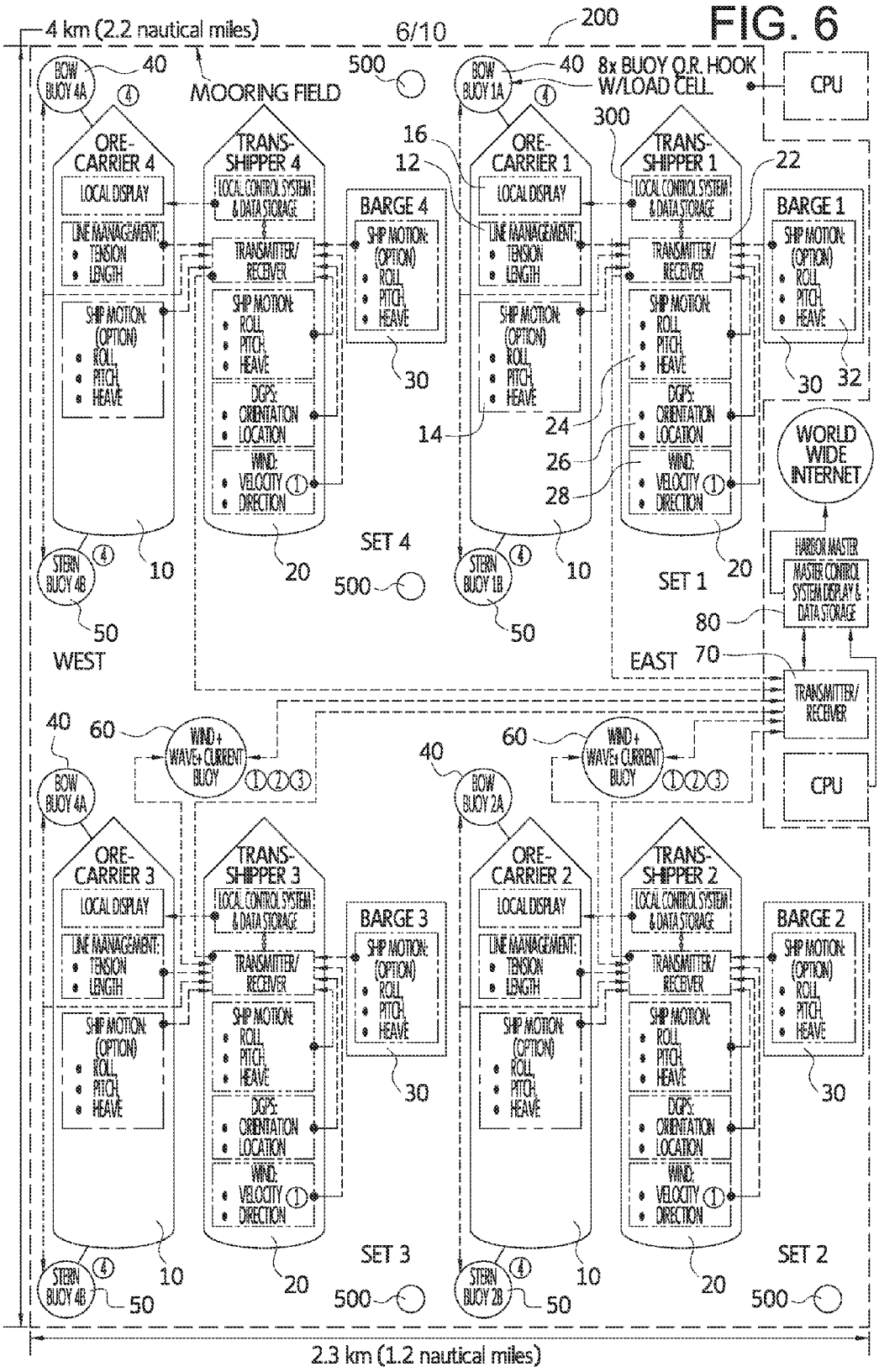
FIG. 6
6/10
4 km (2.2 nautical miles)
200
MOORING FIELD
BOW BUOY 4A
BOW BUOY 1A
8x BUOY Q.R. HOOK W/LOAD CELL
CPU
ORE-CARRIER 4
TRANS-SHIPPER 4
BARGE 4
ORE-CARRIER 1
TRANS-SHIPPER 1
BARGE 1
LOCAL DISPLAY
LOCAL CONTROL SYSTEM & DATA STORAGE
LINE MANAGEMENT: TENSION LENGTH
TRANSMITTER/ RECEIVER
SHIP MOTION: (OPTION) ROLL PITCH HEAVE
DGPS: ORIENTATION LOCATION
WIND: VELOCITY DIRECTION
WORLD WIDE INTERNET
HARBOR MASTER
MASTER CONTROL SYSTEM DISPLAY & DATA STORAGE
STERN BUOY 4B
STERN BUOY 1B
SET 4
SET 1
WEST
EAST
WIND+ WAVE+ CURRENT BUOY
BOW BUOY 2A
ORE-CARRIER 3
TRANS-SHIPPER 3
BARGE 3
ORE-CARRIER 2
TRANS-SHIPPER 2
BARGE 2
STERN BUOY 2B
SET 3
SET 2
2.3 km (1.2 nautical miles)

SYSTEM AND METHOD FOR OFFSHORE LOADING OF CARGO VESSELS

CROSS REFERENCE TO RELATED APPLICATIONS

This patent application claims priority to U.S. provisional patent application Ser. No. 61/591,522, filed Jan. 27, 2012, for all purposes.

BACKGROUND

Offshore mooring of vessels is necessary for a variety of reasons. A common reason is that harbors or ports do not provide sufficient draft for large vessels. Another reason is that the length/beam of such vessels cannot be accommodated in the harbor.

It is frequently necessary to load large cargo vessels by a "lightering" sequence, where one or more smaller vessels bring cargo to the large vessel and sequentially are offloaded to the large vessel. It can be appreciated that sea and weather conditions can impact the ability to carry out this loading procedure.

A representative cargo vessel loading situation will be described, for purposes of this patent application. It is to be understood, however, that the later-described invention may be applied to any of a number of different vessel loading or mooring situations.

By way of example: a large ocean-going vessel, referred to as the "mother ship," must be loaded with a heavy material, such as iron ore. Prior art practice was for the mother vessel to anchor with its own chain and anchor, with a single point anchor arrangement, at a location offshore a shore facility. At times, the mother ship would moor to some fixed structure such as a dock, piling or the like. From whatever single point mooring, the mother ship would be "weathervane" or swing around to a position or heading determined by a combination of the various environmental forces acting upon the vessel. It can be appreciated that the vessel would then move, including heading, pitch and roll, in response to the environmental forces. As is commonly known, the environmental forces on such a vessel include wind, waves, and current. An intermediate vessel, often called a transfer vessel or trans-shipper, can then be moored to the side of the mother ship.

The iron ore or other bulk material being shipped is brought to the mother ship from a nearby shore facility by first loading the ore from the shore facility to a relatively small vessel, such as a barge. The barge then moors to the trans-shipper, the cargo is moved from the barge to the trans-shipper by a crane and scoop or the like, and a conveyor system mounted on the trans-shipper moves the ore from the trans-shipper to the mother ship. A number of barge loads are generally required to load the mother ship.

The above-described sequence is by way of example only. In other situations, the trans-shipper is loaded at the shore facility, and moves to the mother ship for the loading process, eliminating use of the barges. In still other settings, the trans-shipper is moored via a single point mooring, and the cargo vessel is moored to the trans-shipper.

The environmental forces mentioned above (wind, wave, and current) can cause problems with this loading procedure. Under the typical single-point mooring arrangement, all of the vessels, particularly the trans-shipper and the barge, are exposed to the environmental forces. As such forces increase, the effect on the mother ship, and particularly on the (typically) smaller trans-shippers and barges, can render off-loading difficult and hazardous, and in bad enough weather conditions loading may be necessarily stopped. Movement of the mother ship to various headings, and heave, pitch and roll of the mother ship, are examples of undesirable vessel movement.

It would be advantageous to have a system and means to determine the optimum position, principally heading, at which to maintain the mother ship and/or trans-shipper to optimize safe and efficient loading. Such optimization of mother ship and/or trans-shipper position would minimize mother ship movement (both as to heading and heave/roll/pitch), and would create the optimum "lee" area adjacent the mother ship, to shelter the (typically) smaller vessels from the prevailing environmental forces, and to enable safe vessel loading in a much broader range of weather conditions. Optimization of mooring position also results in reduced motions, particularly roll, thereby reducing relative ship-to-ship motions.

SUMMARY OF THE INVENTION

The present invention is a system and method for loading of large cargo vessels or "mother ships," where the mother ship is positioned with respect to environmental conditions of wind, waves, and current, to minimize undesired mother ship and trans-shipper movement and to form an optimal sheltered area on the calm side of the mothership, which may be referred to as the "lee" side. It is understood that the term "lee side" used herein is intended to define the calmer side of a cargo vessel, next to which a trans-shipper would be moored, and while the lee side is generally the downwind side (as that term is commonly used), herein the lee side accounts for waves and current, as well. In particular, mother ship motion, particularly but not limited to roll, can be advantageously reduced by mooring optimization.

In order to enable optimal positioning of the mother ship and trans-shipper, and to minimize the exposure of the trans-shipper to beam waves, a plurality of mooring stations, preferably mooring buoys, are positioned within a defined offshore mooring field. When a mother ship moves into the mooring field in preparation for being loaded, data regarding the vessels (mother ship, trans-shipper, barges), along with current environmental conditions and other variables, are considered when determining which buoys to moor to, and the length/tension of the mooring lines used. One alternative is to determine the mooring buoys, mooring line lengths, etc., without computer assistance, namely by the experience and knowledge of the vessel's personnel, and possibly iterating between mooring points, line lengths and tensions, etc. It is understood that a two-point mooring is to be achieved, with one mooring line attached to the bow and another to the stern of the transhipper, and each of the mooring lines attached to different buoys. To the knowledge of applicant and inventors, use of a two-point mooring system in connection with mooring of motherships in lightering operations is not known in the prior art.

Preferably, in a computer-based embodiment of the system and method of the present invention, such data (as to the vessels and environmental forces) is acquired from instrumentation on the buoys and on the vessels, and is entered into a computer-based program which analyzes such forces for mooring designs, by way of example only a currently available computer program named OrcaFlex. OrcaFlex generates a static and dynamic analysis of ships, buoys, mooring lines and the like. The computer-based program is used to determine which of the plurality of buoys the mother ship should moor to, and the length and tension of the mooring lines, to minimize vessel movement and yield the optimum loading conditions on the lee side of the cargo vessel. As noted above, preferably, the mother ship is moored via two mooring lines, one from bow and stern, each tied off to different mooring buoys. The trans-shipper then moors to the mother ship on the lee side, and the barge moors to the trans-shipper. Material transfer from the barge to the trans-shipper, and from the trans-shipper to the mother ship, is then done. It is understood that the invention encompasses other arrangements, such as the trans-shipper bringing cargo directly to the mother ship (eliminating use of barges); and mooring of the trans-shipper within the offshore mooring field, with the mother ship moored to the trans-shipper.

BRIEF DESCRIPTION OF THE DRAWINGS

FIG. 6 is a more detailed schematic of one embodiment of the invention.

DESCRIPTION OF THE PRESENTLY PREFERRED EMBODIMENT(S)

With reference to the drawings, one presently preferred embodiment of the present invention can be described.

Figure 1:
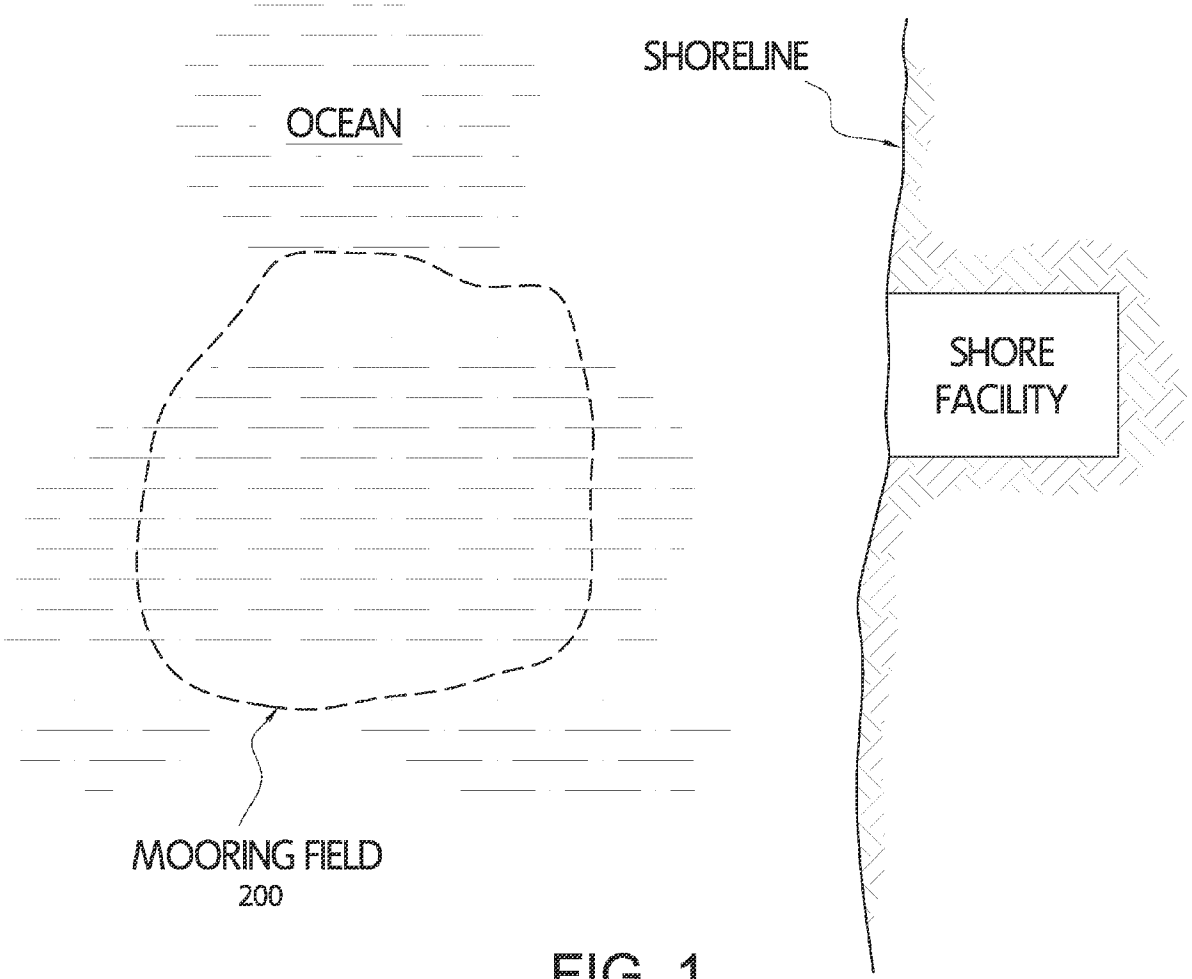
FIG. 1 is a view of a typical offshore loading setting, showing the shoreline, the shore facility from which the cargo is loaded, and the mooring field in the open ocean.

FIG. 1 is a view of a typical loading area or mooring field 200 situated offshore of a shore facility, from which cargo, such as iron ore, is loaded. The mooring field is in sufficiently deep water to accommodate large, oceangoing cargo vessels or mother ships.

Figure 2:
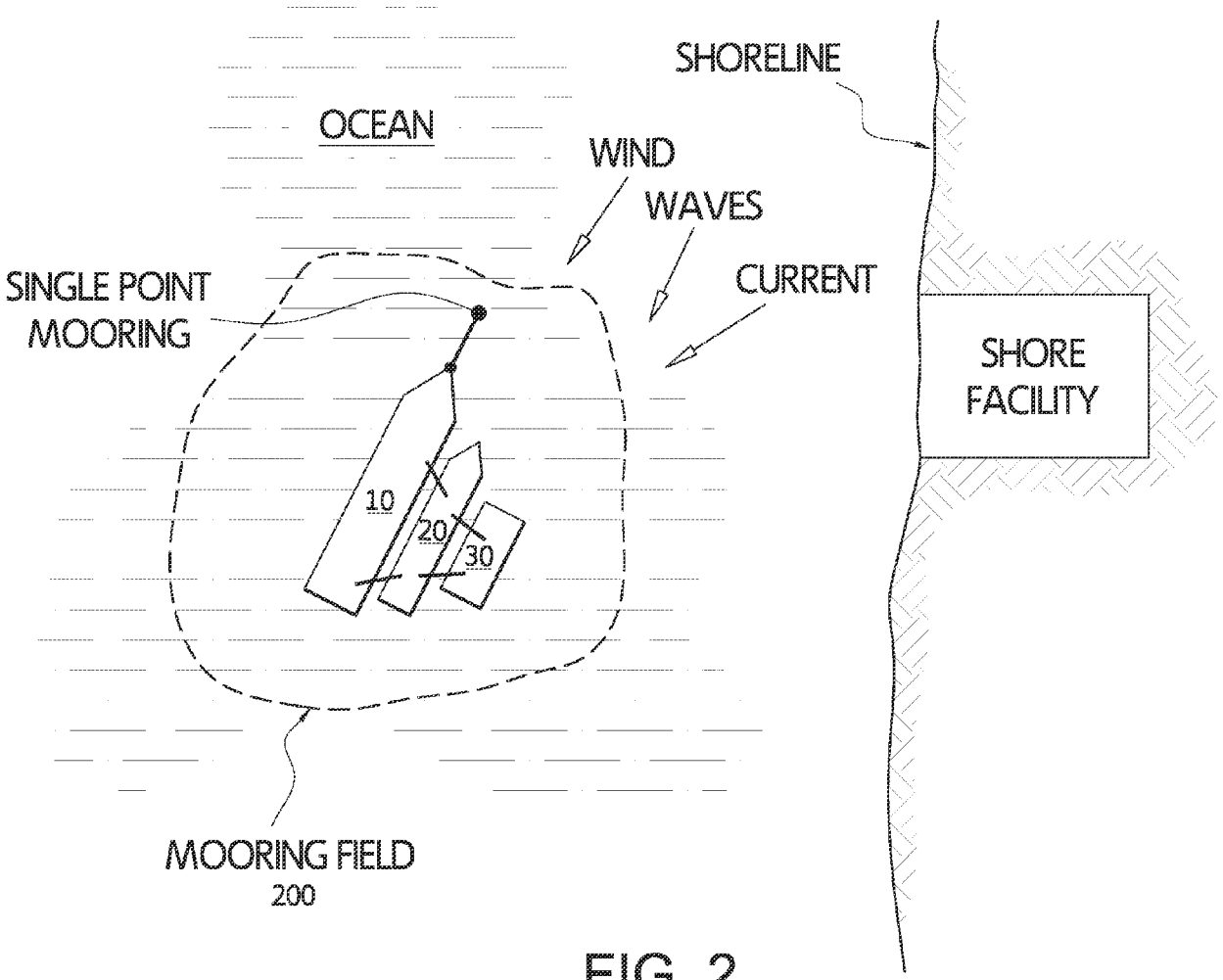
FIG. 2 is a diagram of a prior art cargo loading operation, further showing the mother ship on a single mooring, the transhipper moored to the mother ship, and a cargo barge moored to the transhipper. Prevailing wind, waves and current direction are shown.

FIG. 2 shows a mother ship 10 moored via its own anchor and chain, with the direction of prevailing wind, waves and current shown. In this drawing, which represents typical prior art settings, the mother ship on a single point mooring tends to weather vane on its mooring in response to the environmental forces—typically moving more-or-less to a position headed into the sum of the forces, for example into the wind. A trans-shipping vessel or trans-shipper 20 is moored to the mother ship, and a loading barge 30 moored to the trans-shipper. The barges shuttle back and forth from the shore facility to the trans-shipper, where scoops or buckets deployed from cranes (or similar apparatus) on the trans-shipper move cargo (for example, iron ore) from the barge to the trans-shipper; then, conveyors or similar apparatus move the cargo from the trans-shipper to the mother ship. As can be readily appreciated, with the mother ship in a typical head-on position to the prevailing environmental forces, both the tran-shipper and the barges are fully exposed to the environmental conditions. This can result in those smaller vessels moving too much to enable loading of the mother ship.

Figure 3:
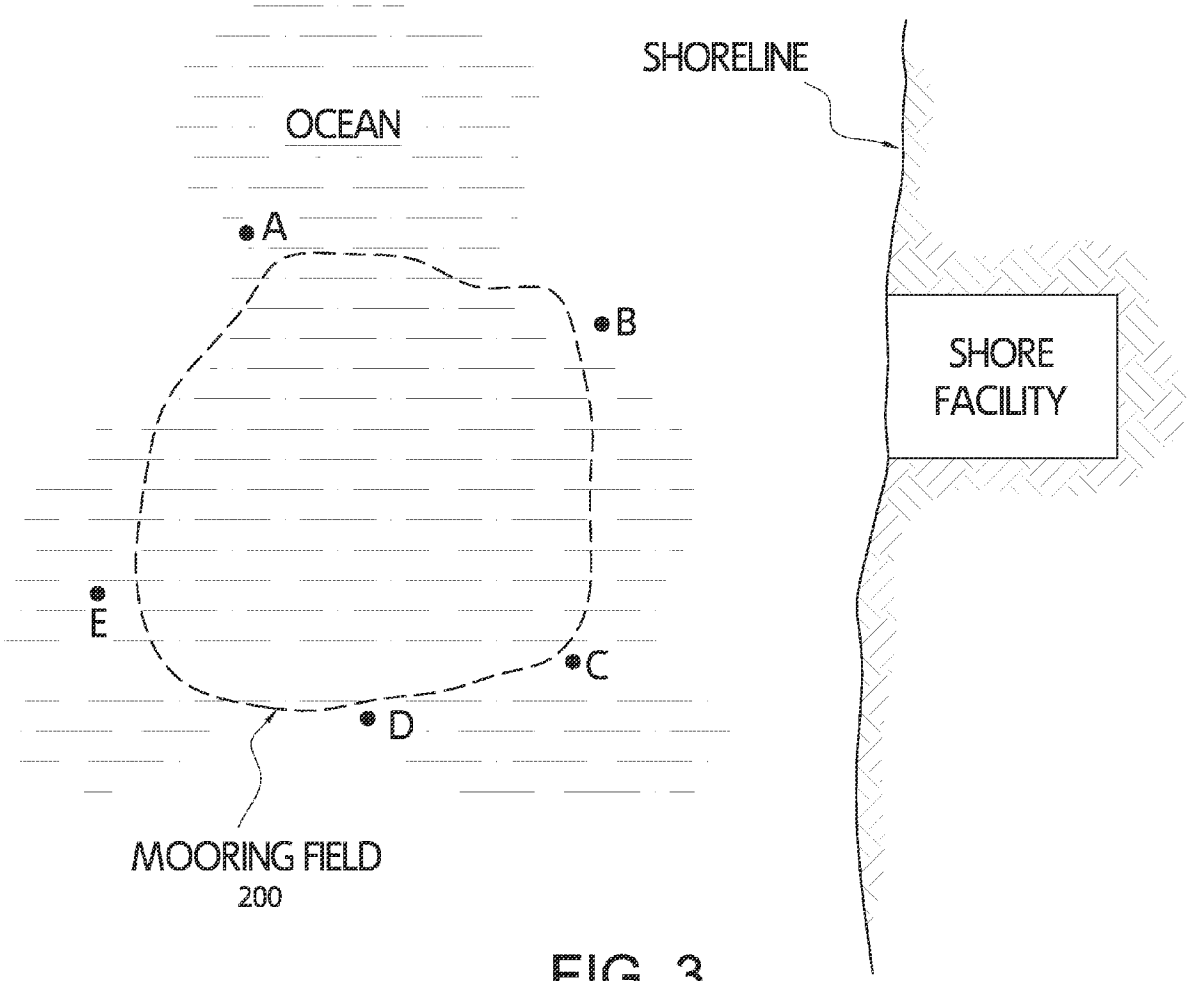
FIG. 3 shows an offshore mooring field with a number of mooring stations, namely buoys (A-E) in place therein.

FIG. 3 is a view of a mooring field 200 with a plurality of mooring stations, for example buoys A-E situated within, positioned by the system of the present invention. It is understood that the mother ship can tie off to any of the mooring buoys. Typically, the mother ship ties off to two of the buoys, with a mooring line running from the bow to one buoy, and another mooring line running from the stern to another buoy. In some embodiments, multiple mooring lines may run from the bow or stern of the mother ship to multiple buoys; for example, two lines from the stern of the mother ship, each fastened to a different buoy.

Figure 4:
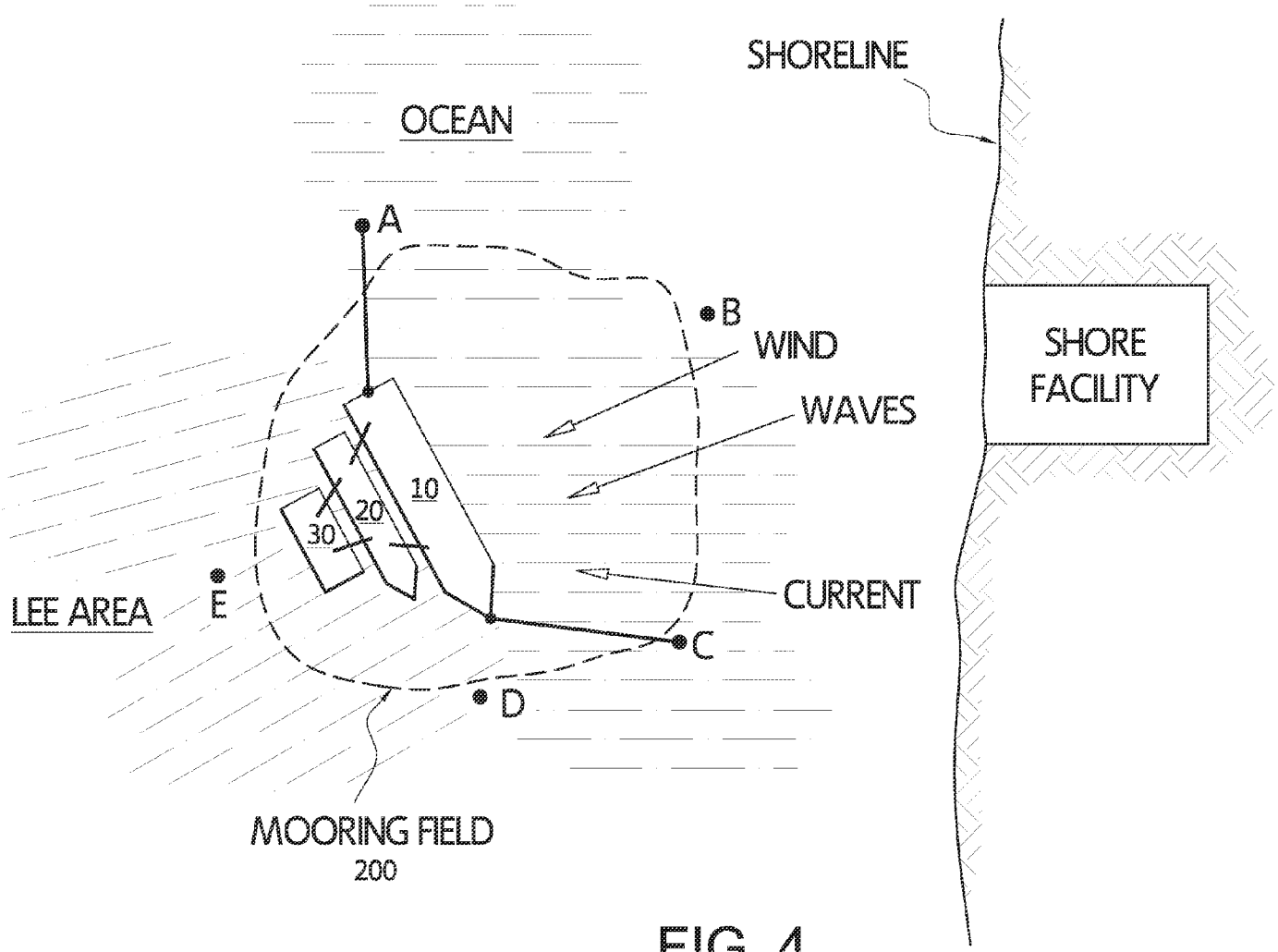
FIG. 4 shows an offshore cargo loading operation, with the mother ship moored via a two-point mooring to two of the mooring buoys, reducing vessel roll and forming a lee area generally on the downwind side of the mother ship, with the trans-shipper and barge moored in the lee area. One set of wind, wave and current conditions (namely direction) are shown.

FIG. 4 is a diagram showing one state of environmental conditions, with the directions of wind, waves, and current shown. Information regarding each of these, including but not limited to direction and magnitude, are input variables to a computer based system. Such environmental information may come from instrumentation mounted on the mooring buoys or on separate buoys, and on the vessels. Additional information is entered, such as physical data regarding the mother ship, the trans-shipper, barges, locations of the mooring buoys, etc.; and information regarding the motion of the vessels, namely heading, pitch/roll/heave. The computer-based system of the present invention then identifies the optimum mooring buoys to tie to, to minimize motion of the mother ship and and other vessels, and yield maximum shielding effect by the mother ship. In FIG. 4, the mother ship ties to buoys A and C in a two point, bow and stern mooring arrangement. The lee area, with the trans-shipper and barge in place, is shown. In general, the goal is to position the mother ship 10 with respect to the combined prevailing environmental forces so as to maximize the lee loading area.

Figure 5:
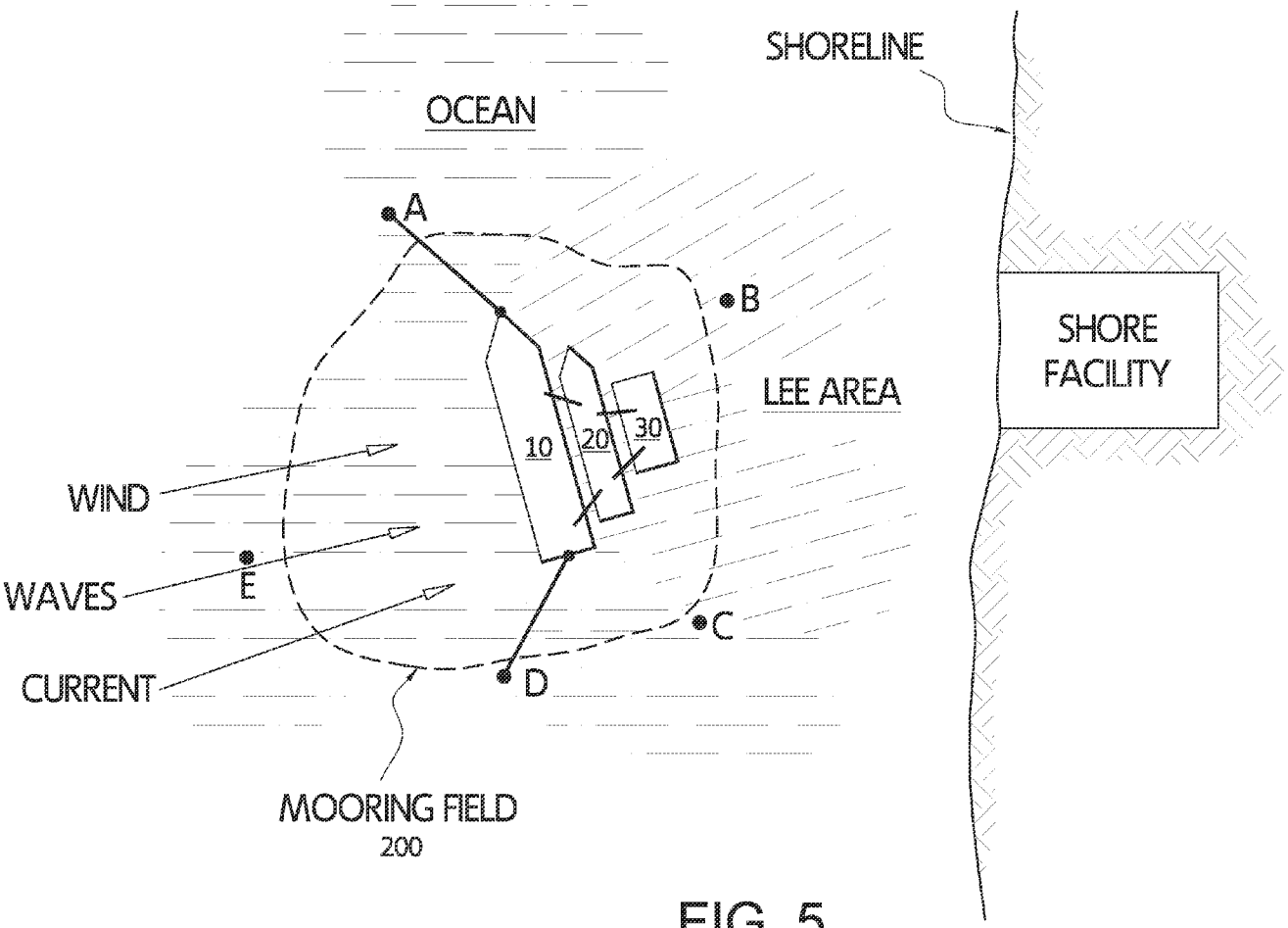
FIG. 5 shows an offshore cargo loading operation under a different set of wind, wave and current conditions.

FIG. 5 is similar to FIG. 4, but shows different environmental conditions, in particular different directions of wind, waves and current. In view of these different conditions, the system of the present invention identifies different mooring buoys for connection to mother ship 10, for example buoys A and D. Again, the resulting lee area, with trans-shipper 20 and barge 30 in place, is shown.

The scope of the present invention extends to the concept of utilizing a large vessel or mother ship which is to be loaded by one or more smaller vessels, to minimize motion of the mother ship and other vessels, and create a relatively calm or lee loading area for the smaller vessels to moor within, to enable cargo loading in rougher weather conditions. Fundamentally, this is accomplished by having the bulk of the cargo vessel block the sum total of environmental forces, namely wind, waves and current. The present invention further encompasses a computer-based system to determine, in a dynamic analysis, which of a number of possible mooring buoys placed within the loading area are best used for a two-point mooring (fore and aft) of the cargo vessel; and the lengths, tensions and other configurations of the mooring lines from the mother ship to the buoys. Further, the system may comprise use of a commercially available, computer based system, including but not limited to the OrcaFlex system, marketed by Orcina Ltd., Daltongate, Cumbria, LA12 7AJ, United Kingdom.

An Exemplary Design of the System and Method

FIGS. 6-10A/10B set out further detail of one exemplary design embodying the principles of the present invention. In connection with the figures, further description is set out below.

FIG. 6 is a plan view of one embodiment of the offshore vessel loading system of the present invention. A mooring field 200 is defined proximal an onshore loading facility; in the illustrated embodiment, mooring field 20 is approximately 4 kilometers (2.2 nautical miles) by 2.3 kilometers (1.2 nautical miles). Larger or smaller mooring fields may be defined.

Provision is made for mooring of four sets of vessels (mother ship, denoted as "ore carrier," trans-shipper, and barge) within mooring field 20. The sets are denoted 1 through 4.

This embodiment provides four sets of bow and stern buoys, as shown in FIG. 6. The bow buoys 40 are denoted "bow buoy" 1A through 4A. The stern buoys 50 are denoted "stern buoy) 1B through 4B. One or more additional data collection buoys 60 are preferably provided, denoted "wind+wave+current buoy," which carry instruments to record and transmit environmental data (namely wind, wave, current) to a central transmitter/receiver 70. Central transmitter/receiver 70, which in the illustrated embodiment is located onshore, communicates with a master control system display and data storage unit 80, which comprises a digital data processor, namely a computer or CPU, which can be monitored by a harbor master, and instructions transmitted back to the various control systems in the mooring field 200.

The mooring control system of the present invention, and its method of use, can be more fully described, taking one of the sets of mother ship/trans-shipper/barges as an example, for example set 1 (upper right hand corner of FIG. 6). Mother ship 10 (ore carrier 1) is moored by a single line or multiple lines from its bow to bow buoy 1A, and a single line or multiple lines from its stern to stern buoy 1B. Instrumentation on mother ship 10, namely line-management system 12, monitors mooring line tension and length. Additional instrumentation, namely ship motion monitoring system 14, monitors mother ship roll, pitch, and heave, in addition to heading. Information (data) from line-management system 12 and ship motion monitoring system 14 is fed to a digital transmitter/receiver 22, which may be positioned on the trans-shipper 20 or other suitable location. A similar set of instrumentation gathers information regarding trans-shipper 20, namely a ship motion monitoring system 24 (monitoring roll, pitch and heave), a digital global positioning system 26, monitoring orientation or heading and location of trans-shipper 20, and an environmental condition monitoring system 28, monitoring wind velocity and direction, and possibly wave and current data. Such information for trans-shipper 20 is also input to digital transmitter/receiver 22, and to central transmitter/receiver 70.

Additional and similar information regarding barge 30, namely a ship motion monitoring system 32 (monitoring roll, pitch, and heave) can also be in place, monitoring such movement of barge 30. This information is input to digital transmitter/receiver 22 and ultimately to central transmitter/receiver 70.

A local control system and data storage unit 300, comprising a digital processor, namely a computer or CPU, may be positioned on trans-shipper 20 or other suitable location. A local display 16 may be positioned on mother ship 10 for use by that vessel's crew, to apprise them of various information regarding the vessels and the environmental conditions.

Control system 300 and/or master control system 80, taking input from various sources as described, processes same to determine appropriate corrections to be made to line management system 12, namely corrections as to line length and tension, as to both bow and stern lines. Such corrections can control the heading of mother ship 10, and consequently trans-shipper 20 and barge 30.

In addition, corrections can include changing which buoys within mooring field 200 the mother ship 10 is moored to. For example, changes in environmental conditions and/or the conditions of the vessels (e.g. as mother ship 10 is loaded) can result in situations that require more correction than can be made via changes in mooring line tension and length. In such cases, the system of the present invention can identify alternate mooring buoys, as noted in FIGS. 3-5, which present optimum or at least improved mooring points, in order to minimize vessel movement and create an optimum lee area for loading. Alternate mooring buoys are shown in FIG. 6 as buoys 500 (which may comprise either bow or stern buoys). One embodiment of the present invention contemplates multiple mooring lines from the bow and/or stern of mother ship 10, each of the mooring lines running to a different mooring buoy, but only one of the mooring lines (that is, one or multiple lines from the bow, and one or multiple lines from the stern) actually being tensioned and in use; the other mooring line, although connecting the vessel and the mooring buoy, is slack. Then, as conditions change, the first mooring line can be slackened, and the second mooring line tensioned and put in use.

Note that in FIG. 6, certain of the reference numerals are omitted on like elements, for clarity.

Figure 7:
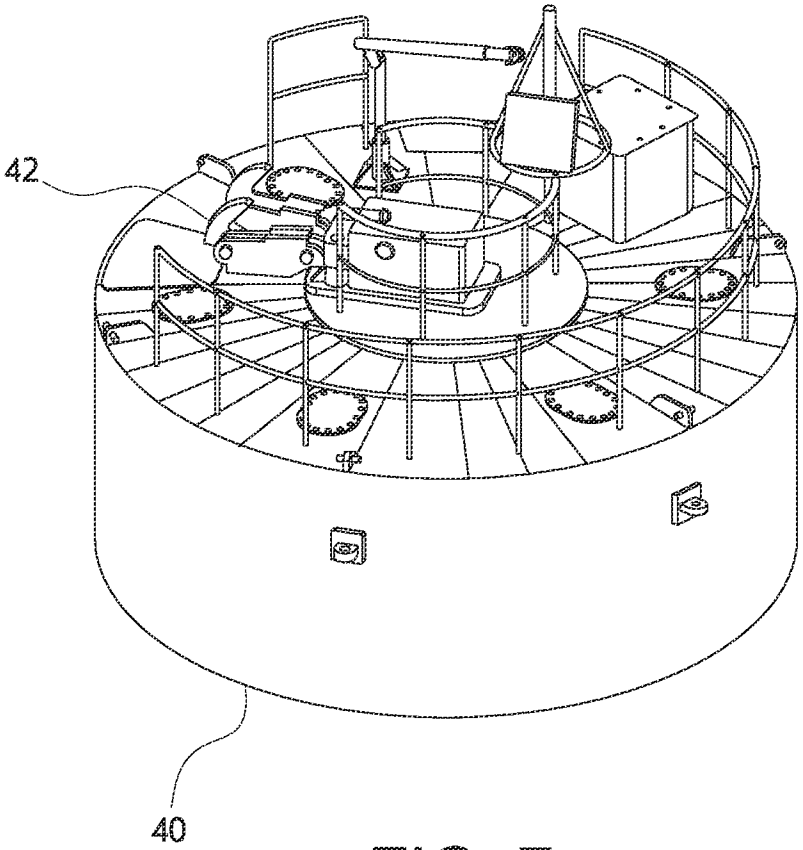
FIG. 7 is a perspective view of a mooring buoy.

Additionally, the present invention preferably comprises mooring buoys comprising a form of remotely operable release mechanism, by which the mooring line can be disconnected from the buoy and taken up by the vessel. FIG. 7 shows an exemplary embodiment of a mooring buoy (which may be bow buoy 40 or stern buoy 50, labeled therein as 40) comprising a remotely operable (by radio frequency or other means known in the art) mooring line release mechanism 42. While various release mechanisms are possible, the illustrated embodiment comprises a pair of remotely movable hooks, over which the mooring line would run.

Figure 8:
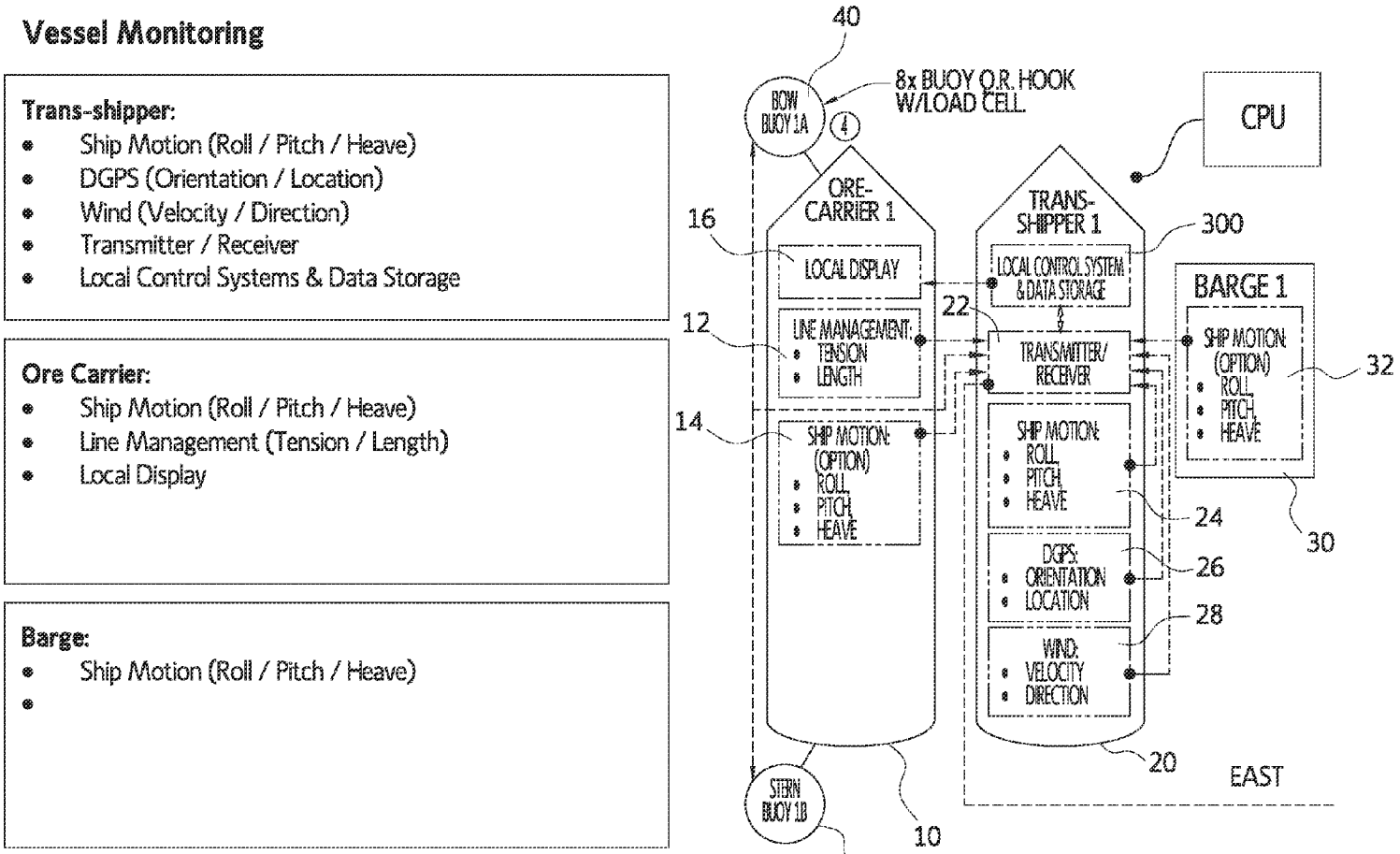
FIG. 8 is a schematic of vessel monitoring criteria and certain elements of the invention.

FIG. 8 shows additional detail regarding the various inputs to the control system of the present invention. The various data processors on the vessels are shown on that page, with various input shown in the boxes under "Vessel Monitoring." Note that the element numbering is consistent with that in FIG. 6.

Figure 9:
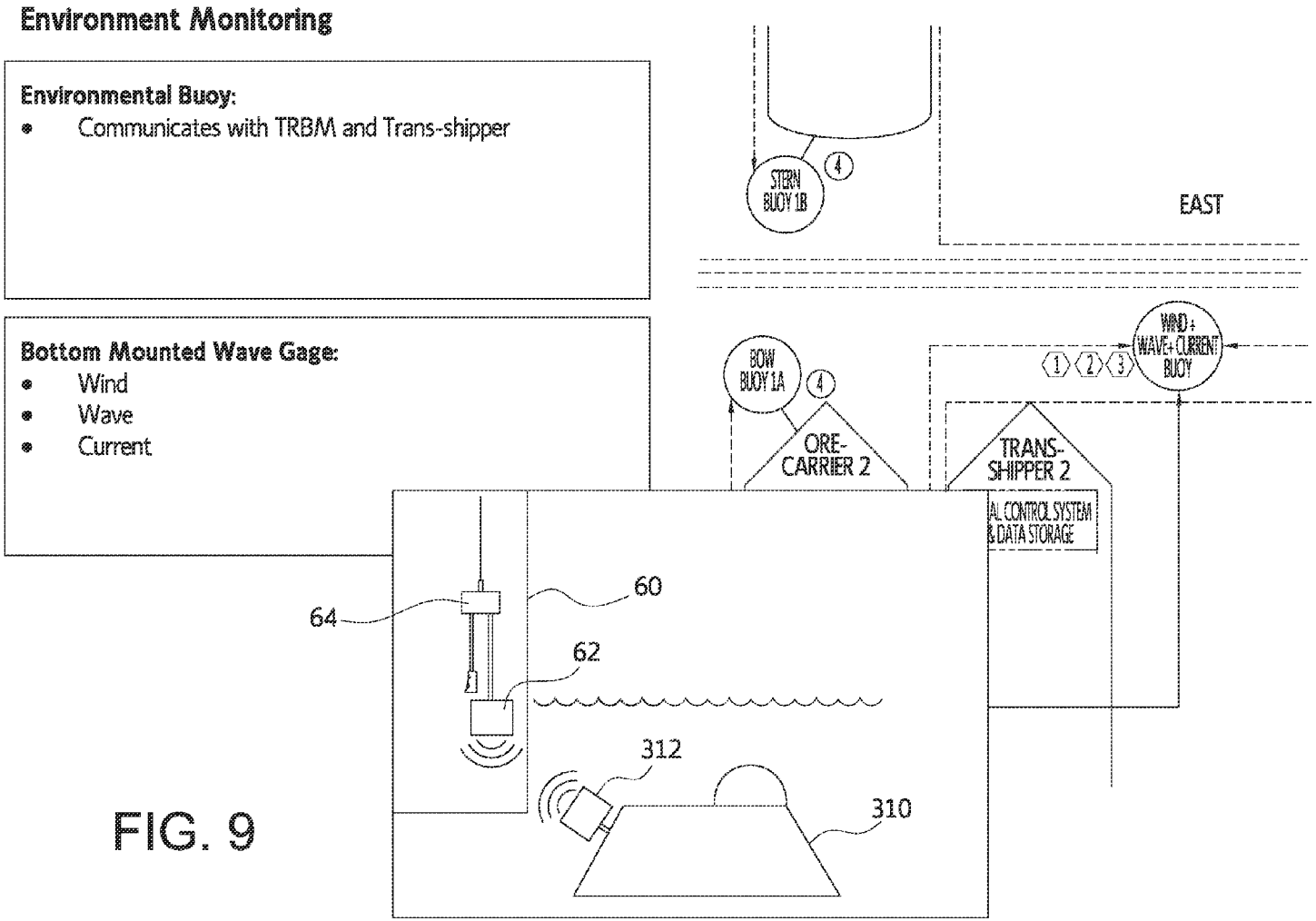
FIG. 9 is a schematic of environment monitoring and certain elements of the invention.

In addition, environmental conditions are monitored and form input to the corrective actions by the line management system. FIG. 9 shows the environment monitoring carried out by the system of the present invention. In one embodiment, environment data is gathered by both a surface buoy 60 and a bottom mounted wave gauge 310. A modem 312 may transmit subsurface wind/wave/current data to surface buoy 60, received by receiver 62. A modem 64 can transmit same to transmitter/receiver 22.

Figure 10B:
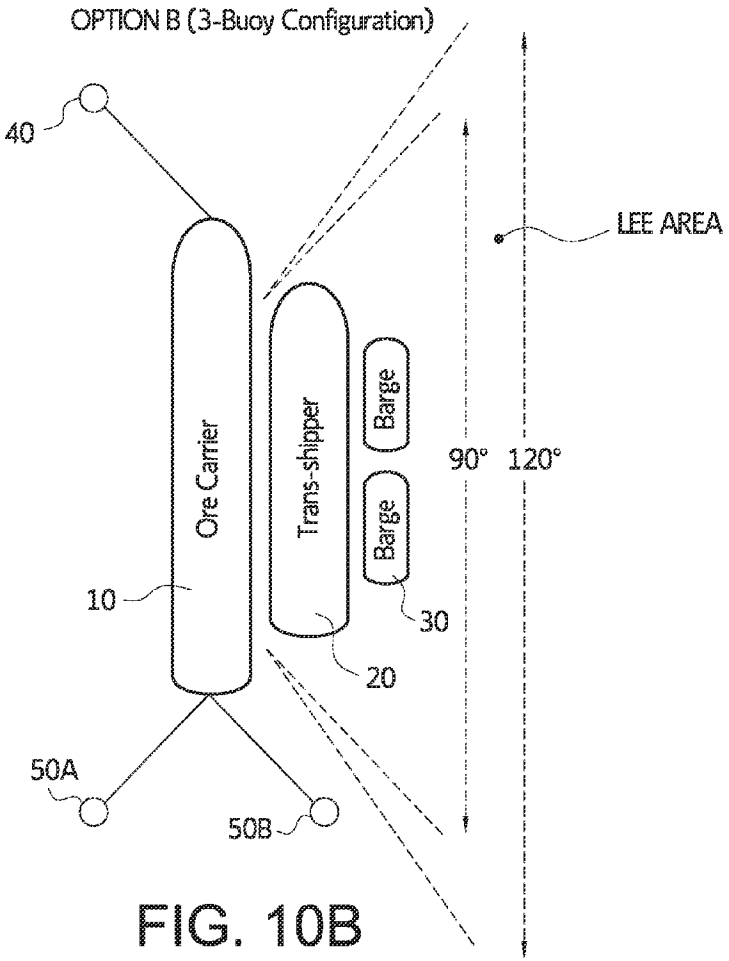
FIGS. 10A and 10B is a schematic of two alternative vessel mooring configurations.
Figure 10A:
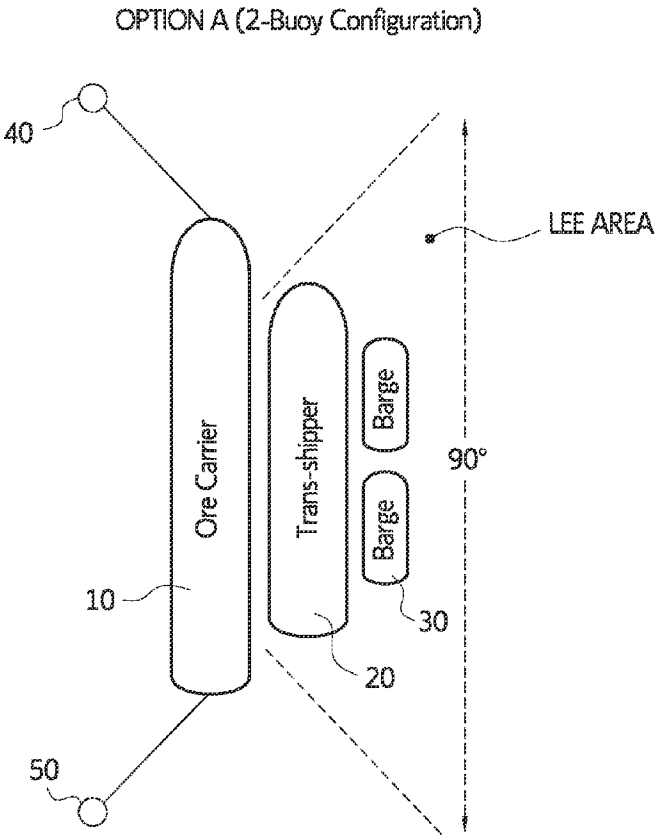

As earlier noted, the present invention encompasses mooring of the mother ship to more than two buoys at one time. Such mooring, which may be referred to as a "3-buoy configuration," may result in improved vessel stabilization and formation of a larger lee area adjacent the mother ship. FIG. 10A shows a 2-buoy configuration, wherein mother ship 10 is moored by a single line off the bow and stern, each of the lines moored to mooring buoys 40 and 50. By way of example, a lee area defined by a 90 degree arc is created, within which the trans-shipper and barge(s) are positioned. FIG. 10B shows the stern of mother ship 10 moored by two mooring lines, to mooring buoys 50A and 50B, thereby further stabilizing mother ship 10. The result is an expanded lee area being formed, by way of example a lee area defined by a 120 degree arc. In like manner, multiple mooring lines may be run off of the bow of mother ship 10.

Use of the Mooring System of the Present Invention

An exemplary use of the mooring system of the present invention may now be described.

One embodiment of the method of the present invention comprises providing an offshore mooring field, proximal an onshore cargo loading facility; providing a plurality of mooring points within the mooring field; positioning a mother ship within the mooring field and mooring the mother ship within the mooring field by mooring lines from the bow and stern of the mother ship to two or more mooring points; positioning a trans-shipper alongside the mother ship; transferring cargo from the trans-shipper to the mother ship; and adjusting the position of the mother ship by adjusting the length and tension of the mooring lines, so as to minimize movement of the mother ship and maximize size of the lee area adjacent the mother ship. The steps of the method of the present invention may further be described to include:

1. gathering environmental data, comprising wind, wave, and current data;
2. gathering vessel motion (roll, pitch, and heave) data, along with data regarding the physical characteristics of the vessel(s);
3. gathering mooring line data, comprising length and tension, and mooring point data;
4. processing the above data, by means of numerical analysis using a digital processor, namely a computer;
5. providing an iterative correction to the mooring heading of the moored vessel (which may be the mother ship or trans-shipper) by means of adjusting mooring line length and tension; and, if necessary, changing the mooring points to which the moored vessel is moored; and
6. repeating steps 1-5 above.

It is understood that in a preferred embodiment, the data gathering and processing described above is done in whole or part by remote means, by radio frequency, satellite transmission or the like; and the processing is preferably done by computer routines carried out by one or more digital processors (computers or CPUs), positioned on the vessels and/or on the shore. Such CPUs are illustrated schematically in FIGS. 6 and 8.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, any number of mooring buoys can be provided in the mooring field; the areal extent of the mooring buoy placement can be changed to suit particular mooring fields; various numbers and types of vessels may be moored within the mooring field, including mother ships, trans-shippers, and other vessels, etc.; and various computer-based systems can be used to carry out the dynamic analysis inherent in implementing the invention.

Therefore, the scope of the invention is to be determined not by the illustrative examples set forth above, but by the appended claims and their legal equivalents.

We claim:

1. A system for offshore mooring and loading of mother ships by use of a trans-shipper positioned adjacent the mother ship, comprising:

a. an onshore cargo loading facility;

b. a mooring field defined in an area offshore said onshore cargo loading facility;

c. a plurality of mooring stations positioned within said mooring field, said mooring stations providing mooring points to connect mooring lines to a vessel;

d. a mother ship positioned within said mooring field and moored to two or more mooring stations via mooring lines from the bow and stern of said mother ship to two different mooring stations;

e. a trans-shipper positioned proximal said mother ship, wherein the mooring stations to which said mooring lines connect, and the lengths and tensions of said mooring lines, minimize movement of said mother ship and create a desired lee area adjacent said mother ship, in which said trans-shipper is positioned.

2. The system of claim 1, further comprising:

a. a means for sensing environmental data within said mooring field, comprising wind, wave, and current sensors, and for remotely transmitting said environmental data to a central processor;

b. a means for sensing movement, location, and heading data of said mother ship and said trans-shipper, and remotely transmitting said movement to a central processor;

c. a means for sensing the lengths and tensions of said mooring lines, and remotely transmitting data regarding said lengths and tensions to a central processor;

d. a means for adjusting the lengths and tensions of said mooring lines;

e. a computer-based means for receiving said environmental data, said mother ship and trans-shipper movement, location and heading data, and said mooring line length and tension data, processing said data; and adjusting said mooring line length and tension in response to said processing.

3. The system of claim 2, wherein said means for sensing environmental data within said mooring field comprises a buoy comprising wind, wave, and current sensing devices, and a means for remotely transmitting said data.

4. A system for offshore mooring and loading of mother ships by use of a trans-shipper positioned adjacent the mother ship, comprising:

a. an onshore cargo loading facility;

b. a mooring field defined in an area offshore said onshore cargo loading facility;

c. a plurality of mooring stations positioned within said mooring field, said mooring stations providing mooring points to connect mooring lines to a vessel;

d. a mother ship positioned within said mooring field and moored to two or more mooring stations via mooring lines from the bow and stern of said mother ship to two different mooring stations; and e. a trans-shipper positioned proximal said mother ship, wherein the mooring stations to which said mooring lines connect, and the lengths and tensions of said mooring lines, minimize movement of said mother ship and create a desired lee area adjacent said mother ship, in which said trans-shipper is positioned, said system further comprising f. a means for sensing environmental data within said mooring field, comprising wind, wave, and current sensors, and for remotely transmitting said environmental data to a central processor;

g. a means for sensing movement, location, and heading data of said mother ship and said trans-shipper, and remotely transmitting said movement to a central processor;

h. a means for sensing the lengths and tensions of said mooring lines, and remotely transmitting data regarding said lengths and tensions to a central processor;

i. a means for adjusting the lengths and tensions of said mooring lines;

j a computer-based means for receiving said environmental data, said mother ship and trans-shipper movement, location and heading data, and said mooring line length and tension data, processing said data; and adjusting said mooring line length and tension in response to said processing, wherein said means for sensing environmental data within said mooring field comprises a buoy comprising wind, wave, and current sensing devices, and a means for remotely transmitting said data, and wherein said mooring stations comprise mooring buoys anchored to the seafloor, and wherein said mooring buoys comprise remotely-operable mooring line release mechanisms.

5. The system of claim 4, wherein said mooring field comprises a plurality of mother ships, each of said mother ships moored to two or more mooring buoys.

6. The system of claim 4, further comprising an onshore data receiver, transmitter, display and storage means for receiving said environmental data, said mother ship and trans-shipper movement, location and heading data, and said mooring line length and tension data, processing said data; and adjusting said mooring line length and tension in response to said processing.

7. A method for transferring cargo from a shore location to a mothership moored offshore, comprising use of a mothership, cargo barges, and a trans-shipper moving cargo from said cargo barges to said mothership, comprising:

a. defining an onshore cargo loading location;

b. defining an offshore mooring field proximal said onshore cargo loading location, for mooring of a mothership, into which said cargo is to be loaded, said offshore mooring field comprising a plurality of mooring stations;

c. moving said mothership into said offshore mooring field;

d. mooring said mothership within said offshore mooring field by a first mooring line connecting a bow of said mothership to a mooring station, and a second mooring line connecting a stem of said mothership to a different mooring station, wherein the lengths of said first and second mooring lines, and which of said plurality of mooring stations to which said first and second mooring lines are connected, are determined based on environmental conditions comprising wind, wave, and current conditions within said mooring field, and by consideration of the physical characteristics and movement data of said mothership, said transhipper, and said loading barges;

e. mooring said trans-shipper adjacent said mothership;

f. moving cargo in said cargo barges from said onshore loading area to said transhipper; and g. moving said cargo from said cargo barges to said mothership by use of said trans-shipper.

8. The method of claim 7, wherein said step of determining said lengths of said mooring lines and which of said plurality of mooring stations to which said mooring lines are connected are determined by:

I) gathering environmental data comprising wind, wave and current data;

ii) gathering data regarding motion of said motion ship, comprising roll pitch and heave of said mothership;

iii) gathering mooring line length and tension;

iv) processing said data by use of a computer, wherein said computer utilizes a numerical analysis;

v) providing a correction to said mooring heading; and vi) adjusting said mooring heading by adjusting said mooring line lengths and tensions.

9. The method of claim 8, wherein said mooring line lengths and tensions are adjusted so as to minimize movement of said mother ship.

10. The method of claim 8, wherein said mooring line lengths and tensions are adjusted so as to create an optimum lee loading area proximal said mother ship.

11. The method of claim 8, wherein said mooring line lengths and tensions are remotely adjusted from an onshore location.

* * * * *